US006796205B2

(12) United States Patent
Wickes et al.

(10) Patent No.: US 6,796,205 B2
(45) Date of Patent: Sep. 28, 2004

(54) VARIABLE-STROKE PLIERS

(76) Inventors: Roger D. Wickes, 887 Birds Mill, Marietta, GA (US) 30067; David L. Wickes, 31 Old Ebenezer Rd., Lebanon, PA (US) 17046-1719

( * ) Notice: Subject to any disclaimer, the term of this patent is extended or adjusted under 35 U.S.C. 154(b) by 0 days.

(21) Appl. No.: 10/365,368

(22) Filed: Feb. 12, 2003

(65) Prior Publication Data

US 2004/0154441 A1 Aug. 12, 2004

(51) Int. Cl.[7] ..... B25B 7/00

(52) U.S. Cl. ..... 81/427.5; 81/393; 81/177.8; 81/177.9; 81/180.1

(58) Field of Search ..... 81/427.1, 393, 81/177.8, 177.9, 177.7, 177.2, 180.1, 427.5

(56) References Cited

U.S. PATENT DOCUMENTS

| | | | | | |
|---|---|---|---|---|---|
| 1,123,243 | A | * | 1/1915 | Champ | 81/393 |
| 1,142,797 | A | | 6/1915 | Burrell | |
| 4,519,278 | A | * | 5/1985 | Heldt | 81/427.5 |
| 4,662,251 | A | | 5/1987 | Kohal | |
| 4,742,736 | A | * | 5/1988 | Williams | 81/303 |
| 4,754,668 | A | * | 7/1988 | Oetiker | 81/9.3 |
| 4,890,520 | A | * | 1/1990 | Vassiliou | 81/365 |
| 5,520,040 | A | | 5/1996 | Petterson | |
| 5,540,122 | A | | 7/1996 | Lund | |
| 5,626,061 | A | | 5/1997 | Whitley | |
| 5,743,131 | A | | 4/1998 | Holliday et al. | |
| 5,832,793 | A | | 11/1998 | Collins | |
| 5,868,748 | A | | 2/1999 | Burke | |
| 5,870,925 | A | | 2/1999 | Morris et al. | |
| 5,887,492 | A | | 3/1999 | DeLaney | |
| 5,887,495 | A | | 3/1999 | Kao | |
| 6,227,081 | B1 | | 5/2001 | Bally | |
| 6,286,358 | B1 | | 9/2001 | Beetz et al. | |
| 6,318,215 | B1 | | 11/2001 | Armfield | |
| 6,347,565 | B2 | | 2/2002 | Steinweg | |
| 6,367,355 | B1 | | 4/2002 | Tanne | |
| 6,370,985 | B1 | | 4/2002 | Wu | |
| 6,474,130 | B2 | * | 11/2002 | Battenfeld | 72/409.07 |
| 6,481,034 | B2 | | 11/2002 | Elsner et al. | |

* cited by examiner

*Primary Examiner*—Joseph J. Hail, III
*Assistant Examiner*—Alvin J. Grant
(74) *Attorney, Agent, or Firm*—Thomas, Kayden, Horstemeyer & Risley, LLP

(57) ABSTRACT

The device has affair of handles each coupled to a tong, which are movable to clamp or release the target. A ratchet mechanism couples to a handle to re-vector the handle in order to reduce the operational footprint of the device to accommodate obstacles and operate successfully in confined and limited access spaces. Operation of the apparatus allows the action to be accomplished over a variable number of strokes, with the distance of each stroke, and thus the arc of the handles traversed, varying with each stroke, while still accomplishing the desired action.

14 Claims, 6 Drawing Sheets

VARIABLE-STROKE PLIERS

FIELD OF THE INVENTION

The invention relates generally to mechanical device, and more specifically, to an apparatus, system, and method for clamping, cutting, forming (crimping), gripping, and/or turning a material in confined and limited-access spaces.

BACKGROUND OF THE INVENTION

Pliers have existed for centuries as a simple hand tool. Normal pliers can be described as having a set of tongs connected to a set of handles by a pivot pin. As the handles are separated, the tongs spread apart, and vice versa. Generally, the tongs are shorter than the handles so that the principle of leverage can be used to multiply the user-applied force to the force of the tongs operating on a target.

More advanced pliers use levers around the pivot point to further multiply the force and motion of the handles to the tongs. The tongs can be shaped to either squeeze, form, deform, cut, shear, emboss, or simply hold the target; i. e. perform an intended function. One skilled in the art would know that the handles can be operated by a human or a machine. One skilled in the art would know that handles and tongs can be shaped variously and made from various materials. A normal pliers' tong and handle are formed from the same piece of metal for strength reasons, although there are advanced pliers that use gears, springs, and levers, with or without locking mechanisms, to provide other advantages. Other pliers use a general purpose shank on which specific-purpose heads and dies are mounted, thus forming a tong.

In operation, the pliers are opened to the point where the tongs can fit around the target, positioned such that the tongs are placed at the desired point around the target, and then closed to perform their intended function. The work is accomplished during the final operation, the stroke wherein the handles are closed and thus the tongs. In normal pliers, this can be called a fixed or single stroke; the tongs go from opened to closed as the user makes a single stroke on the handles to close them.

In certain real world situations where the operating space is confined (narrow), the pliers cannot be sufficiently opened to fit around the target. In these situations, the pliers are useless and the space must be modified to allow pliers operation, or the target relocated to a more favorable location. Since the principle of leverage is used and in reality the tongs are connected to the handle at the pivot point, there is a fixed ratio between the angle formed by the handles and that formed by the tongs. If levers are used around the pivot point, there is a linear relationship between the angles. One skilled in the art would know that gears, springs or other mechanisms could be used to transfer the force from the handles to the tongs, resulting in some ratio of movement.

A target is of some width, and the plier's tongs must be separated to fit around the target's initial size. Since there is a relationship between the angles, in order to fit the tongs around some target, the handles have to be spread apart some corresponding distance. As the handles spread, their motion follows an arc. In order to operate, this arc, and the path resulting from the motion of the handles, generally should be unobstructed. Sometimes, obstructions may be overcome, however, by partially completing the action with one stroke, opening the pliers, and repeating the operation on the other side of the obstacle. However, that may not always be the case.

Pliers become useless and cannot perform their intended function when these obstructions prevent any of the steps in operation, which include the opening of the pliers, the positioning of the opened pliers, or the complete closing action of the tongs/handles. A device for manipulating a target that is located in a confined space is provided for the purpose of gripping, forming (with or without dies), deforming/cutting, or turning the target. Moreover, conditions may arise that prevent the positioning of the pliers such that the tongs cannot be placed around the target, perhaps due to a comer or tight space that blocks the handles at the end point or some midpoint. Furthermore, conditions may arise that prevent the closing of the handles and therefore the complete operation of the pliers.

Thus, a heretofore unaddressed need exists in the industry to address the aforementioned deficiencies and inadequacies.

SUMMARY OF THE INVENTION

The present invention replaces one or both plier handles with a variable reversing ratchet and its operation, or a ratcheting operation, using a fixed ratchet. Further, the present invention changes the stroke operation of the pliers from a fixed stroke to a variable number of strokes to accomplish the work. Further, by introducing an additional pivot point, the relationship between the tong separation and handle separation changes from a ratio to a non-continuous function. By incorporating a ratchet into the handle, a unique device is formed that provides advantages over a normal pliers without sacrificing performance.

The present invention overcomes obstructing conditions in the real world by changing one or both handles such that the opening and/or closing action is not necessarily accomplished in a single stroke, but in multiple strokes. Further, each stroke does not have to follow the same arc; varying arcs can be used to avoid obstacles.

A preferred embodiment consists of a handle and shaft, pivot mechanism, ratchet receptacle bar, ratchet mechanism (socket wrench), and two tongs. One tong is connected to the handle, and the other tong is connected to the ratchet receptacle bar. The connected handle, tong, and shaft are joined to the ratchet receptacle bar and other tong at some point along their length by the pivot mechanism.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

Figure 1:
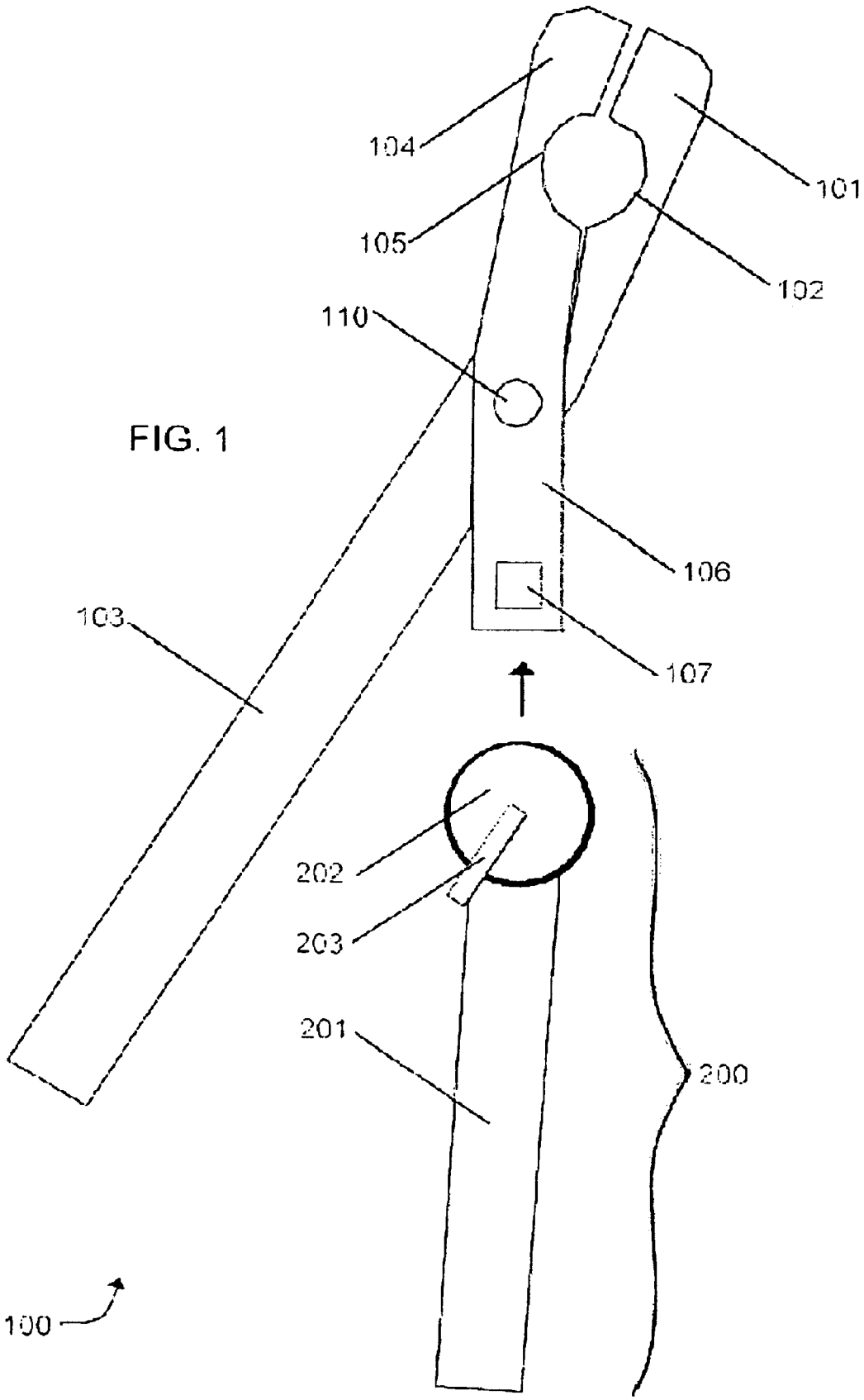
FIG. 1 is a diagram of a preferred embodiment of the invention, showing the ratcheting handle.

FIG. 1 shows a frontal view of the components of a variable stroke pliers 100. A tong 101, shaped, in this non-limiting example, for deforming a metal ring by indentation 102, is attached to a handle 103. In this non-limiting example, the tong 101 and handle 103 are shown as molded together, but one skilled in the art would know that there are many means of forming these two pieces together. The left tong 104, with matching indentation 105, is attached to ratchet receptacle bar 106. In this non-limiting example the tong 104 and bar 106 are shown as molded together, but one skilled in the art would know that there are many means of forming these two pieces together. One skilled in the art would know that indentations 102 and 105 can be replaced by any type of die.

Figure 2:
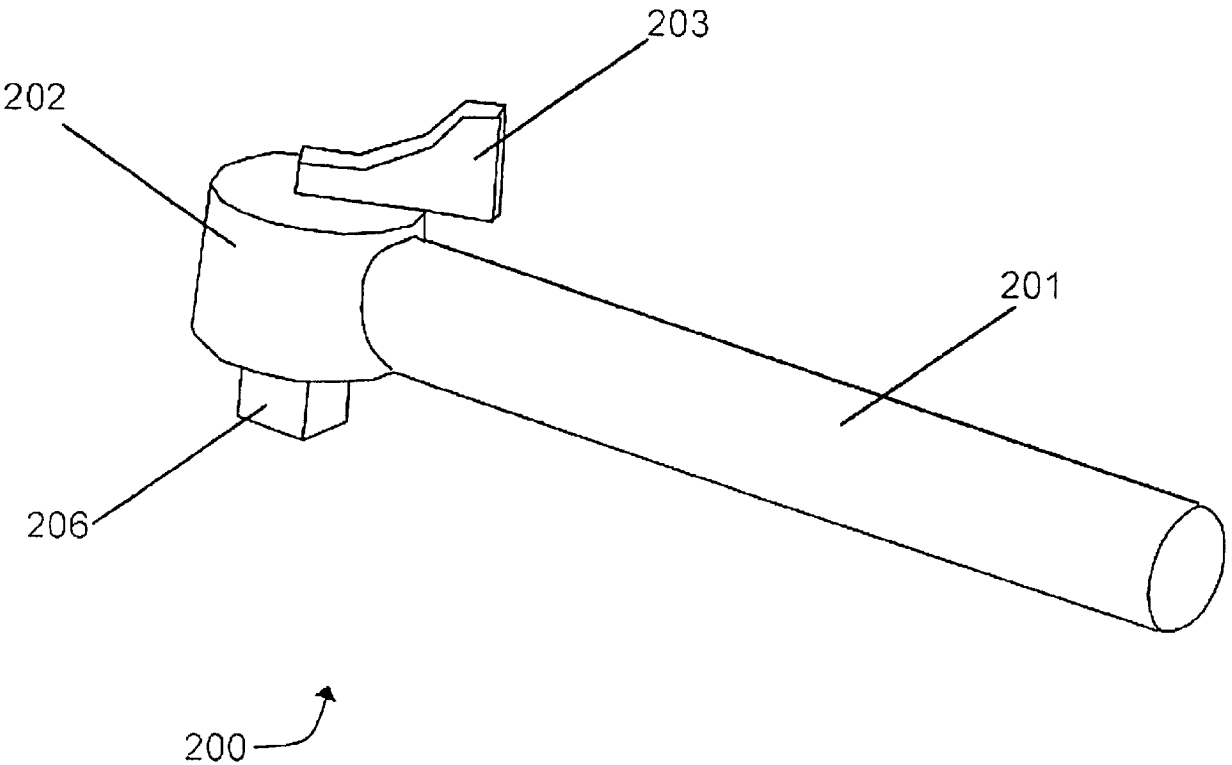
FIG. 2 is a diagram of the ratcheting handle of FIG. 1.

Bar 106 has a shank receptacle 107 that allows the shank of a ratchet wrench 200 to be inserted. As shown in FIG. 2, a ratchet wrench 200 is, in this non-limiting example, comprised of handle 201, ratcheting mechanism 202, ratchet directional control switch 203, and a shank 206. A ratchet gear, spring, and ratcheting pin are encased within the body of the ratchet wrench 200. One skilled in the art would know that a variety of tools could be used in lieu of a ratchet wrench. One skilled in the art would know that there are various means of attaching handles to shafts, shafts to shanks, tongs to handle, tongs to ratchet receptacle bars, including but not limited to single casting, welding, bolting, glue, riveting and pinning.

In operation, the ratchet wrench's shank 206 (FIG. 2) is inserted into a socket. A switch 203 on the top locks the transfer of force in either the clockwise or counterclockwise direction. When moved in the non-locked direction, the shank 206 remains stationary while the handle 201 rotates. One skilled in the art would know that the ratchet receptacle bar 106 can be temporarily or permanently affixed to the ratchet mechanism. In the case of the temporary connection, the socket wrench 200 can be removed and used for other purposes. One skilled in the art would know that the ratchet receptacle bar 106 (FIG. 1) is essentially linear but can take many different shapes to accomplish the action of transferring the force from the ratchet mechanism's shank to rotational action of the tong around the pivot point.

One skilled in the art would know that the shank 206 of the ratchet 200 can be formed to include the ratchet receptacle bar 106 in a single piece. One skilled in the art would know that a tong 104 and ratchet receptacle bar 106 can be formed in one single piece. One skilled in the art would also know then that the tong 104, ratchet receptacle bar 106, and the shank 206 can be formed from a single piece.

One skilled in the art would know that there are many ways to form pieces through casting, deformation, milling, machining, grinding, building up, cutting and any combination of those common processes. One skilled in the art would know that there are many ways to transfer the force exerted on the ratchet mechanisms' handle to its shaft, including gears, springs, and friction plates. One skilled in the art would know that the ratchet 200 may transfer that force in one direction, or, by means of the switch 203, afford effort transfer in the other direction as well. One skilled in the art would is know that the handles 103, 201 can be operated by human or mechanical means.

In this non-limiting example, the receptacle 107 (FIG. 1) and shank 206 (FIG. 2) are essentially square, but one skilled in the art would know that the opening can be any shape that allows a mating and friction action to transfer the force on the ratchet handle 201 into a rotational force around the shank receptacle 107 and thus to the ratchet receptacle bar 106. One skilled in the art would know that the projecting shape of a US standard (non-metric) socket wrench shank 206 may be ¼ or ½ inch square, but can be any size or shape, so long as a sufficient mating and friction occurs between the shank 206 and the receptacle opening 107 in the ratchet receptacle bar 106, such that force on the ratcheting mechanism 200 is transferred to the ratchet receptacle bar.

Pivot pin 110 connects handle 103 to bar 106. One skilled in the art would know that there are many means to accomplish a pivot mechanism, including but not limited to pin, rivet, nut and bolt, levers and stays, and cams and stays.

Figure 3A:
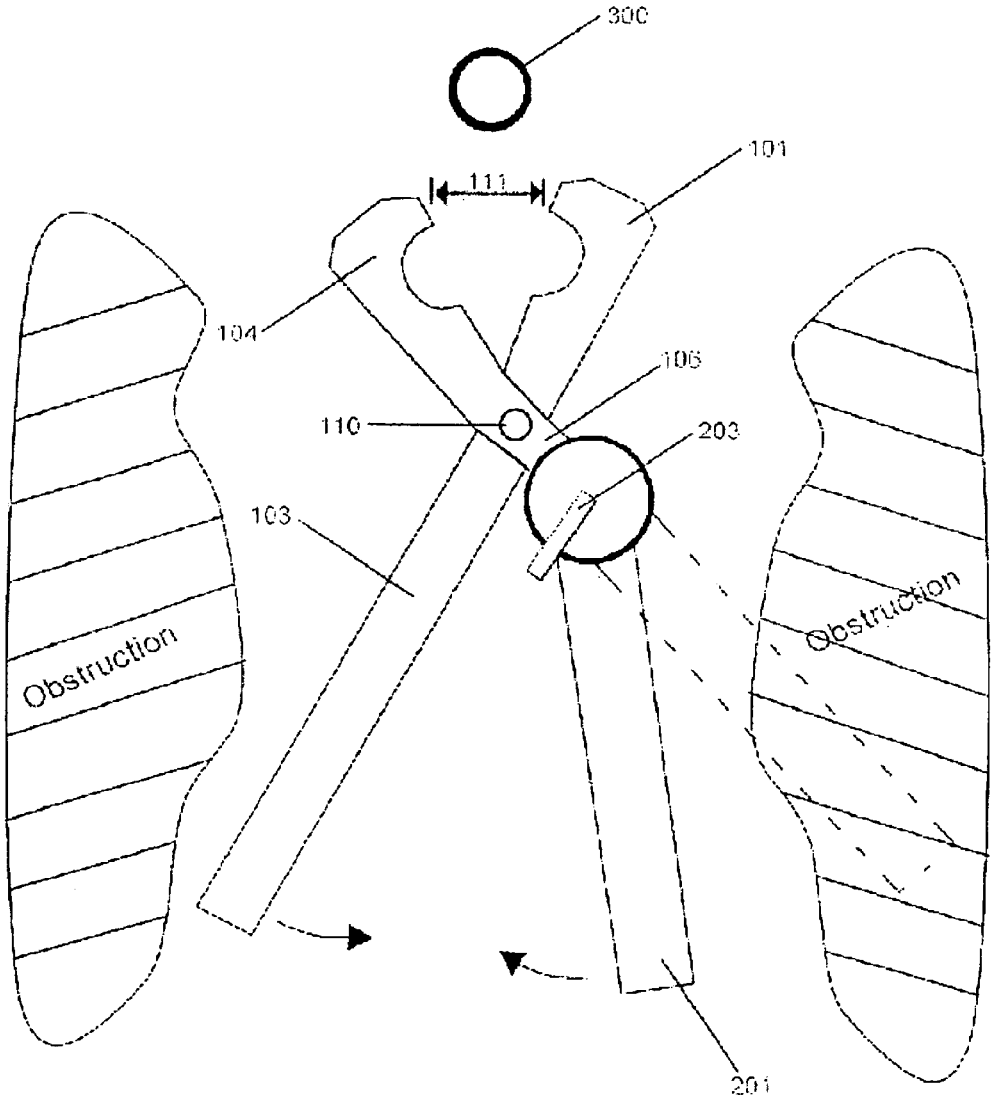
FIGS. 3A–3C are diagrams of the preferred embodiment of the invention in its closure mode, wherein operation is progressively shown closing the tongs.
Figure 3B:
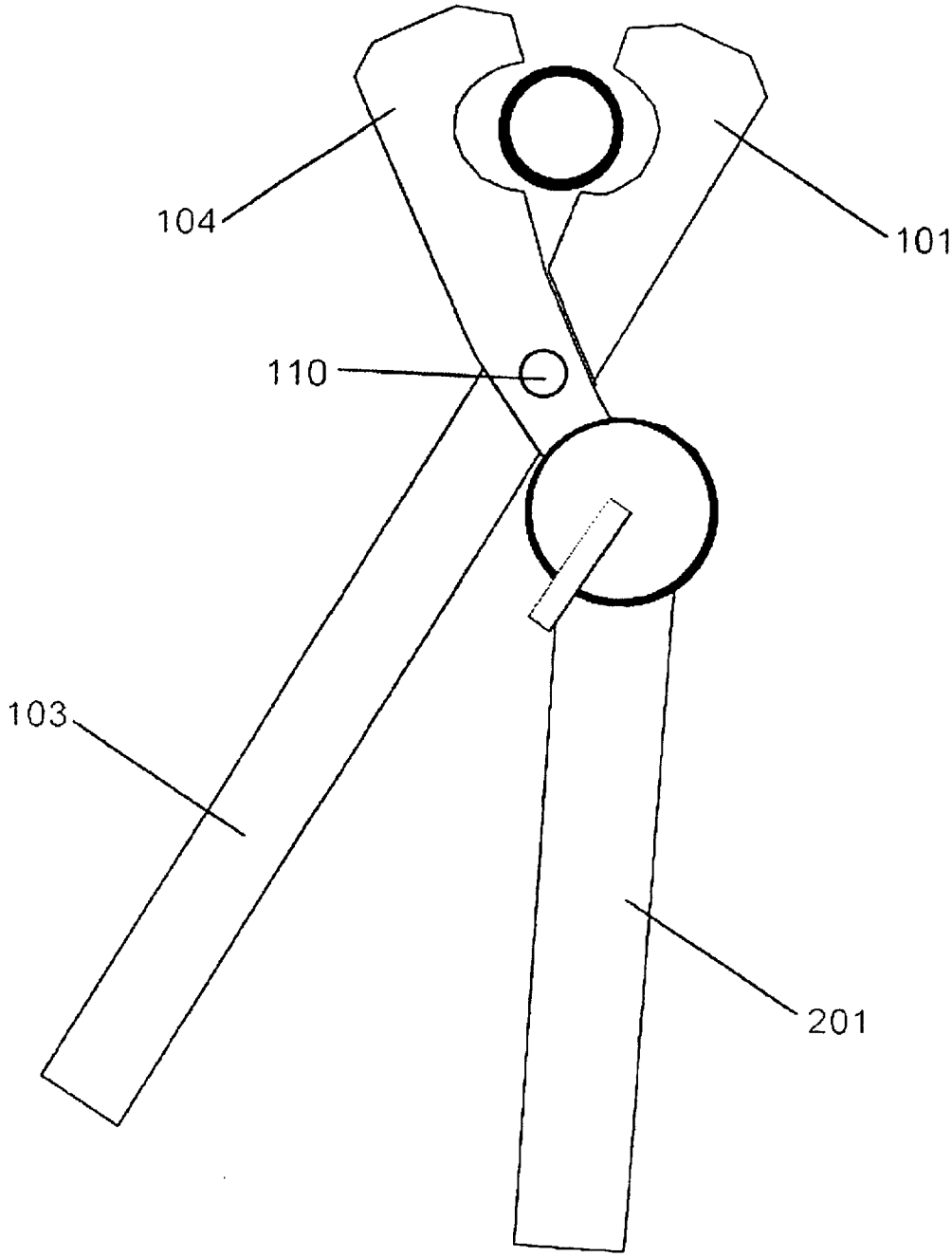

FIG. 3A shows the variable stroke pliers open and ready for action. The tongs 101, 104 are open by a distance indicated as 111 on either side of a target 300. Note that the position of the ratchet wrench switch 203 is set to lock so as to transfer the clockwise force on the ratchet wrench handle 201 to the shank 206 and on to the ratchet receptacle bar 106. In this non-limiting example, the other handle 103 is held in essentially the same position, and the ratchet wrench 200 is pushed to the left. Because of pivot pin 110, this action spins the ratchet receptacle bar 106 in a clockwise direction, and thus the tong 104 to the right, toward the other tong 101. FIG. 3B shows the location of the handles and tongs after a partial stroke.

At some point, the operator may cease the force to the left and reverse force to push the ratchet handle 201 to the right. Because of the ratcheting action previously described, the tongs 101, 104 remain stationary and the device assumes the position indicated in FIG. 3A, but with the tongs 101, 104 closer together. Thus, repetitions of this action will eventually close the tongs 101, 104 completely. The amount of each closure stroke can vary, as can the amount of closure desired.

Figure 3C:
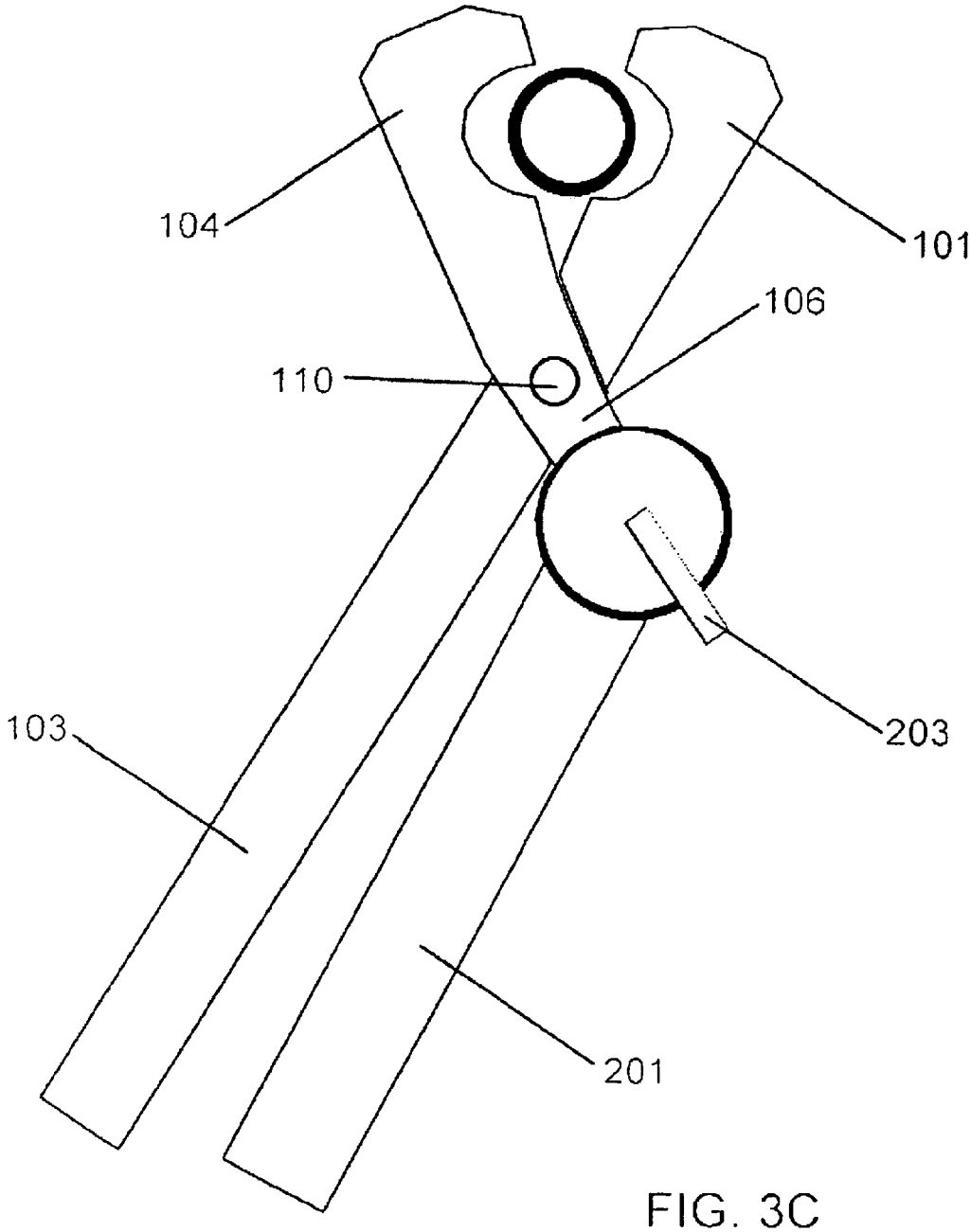

At some point, the operator may wish to remove the pliers 100 from the target 300, shown in operation in FIG. 3C. Reversing switch 203 and pushing the handles apart will cause the tongs 101, 104 to separate. At some point the operator may cease pushing the ratchet wrench handle 201 (and or other handle 103) and reverse force on the handle(s), pushing at least the ratchet wrench handle 201 to the left. Because of the ratcheting action previously described, the shank 206 (not shown in this perspective; positioned into bore 107) (and thus all attached components bar 106 and tong 104) remains stationary. A non-limiting example of the location of the handle 201 is shown in FIG. 3C; the two handles 103 and 201 are shown close together, but the tongs 101, 104 have separated. The operator resumes moving the handle 201 of the ratchet wrench 200 to the right, and the action just described repeats.

In FIGS. 1, 3A, 3B and 3C, the handles 103, 201 are shown as not crossing, however, one skilled in the art would know that the handles 103, 201 may cross over one another if vertically designed to do so without interfering with each others' path.

Figure 4:
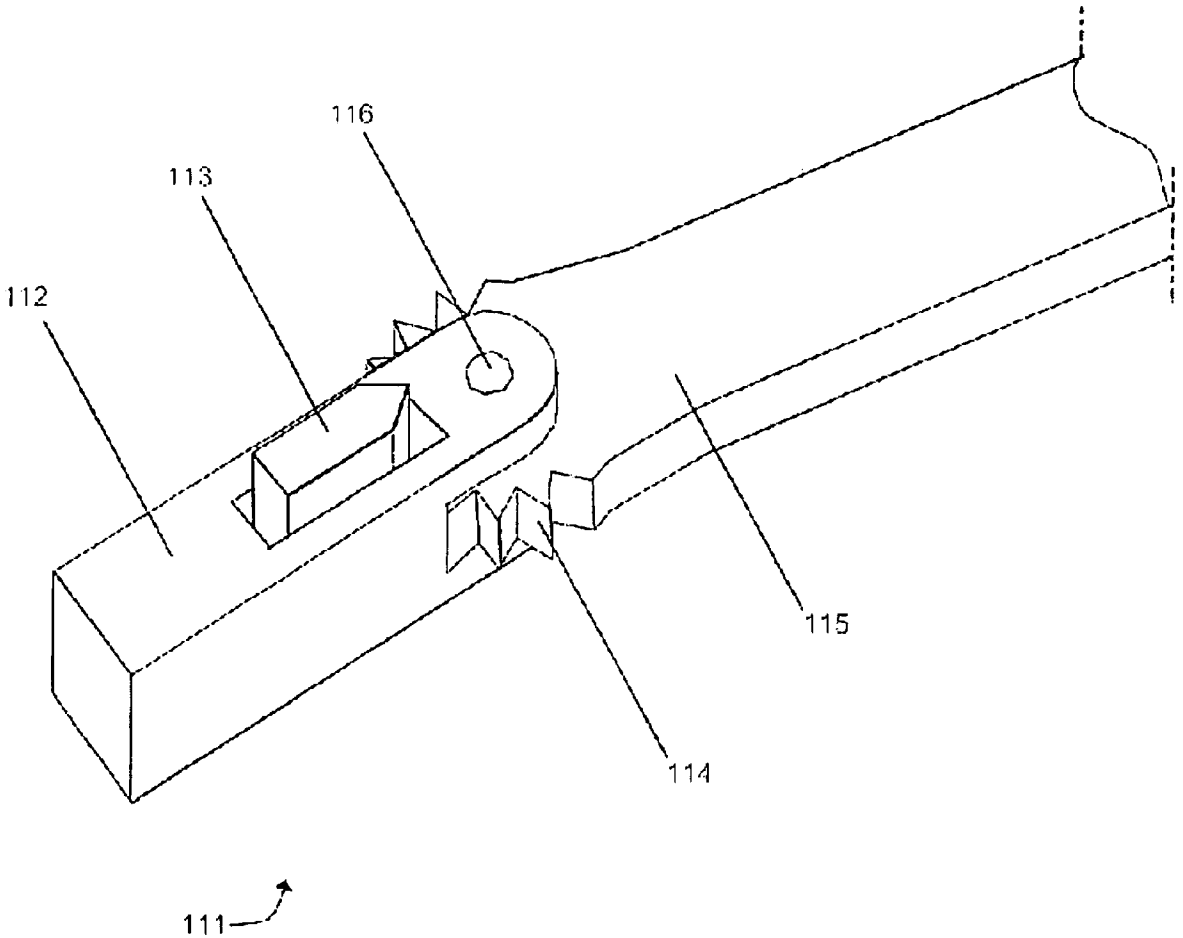
FIG. 4 is an alternative embodiment of the invention, showing an integral ratchet device.

As an alternative to using a separate ratchet (socket) wrench, one skilled in the art would know that there are many ways to form an integral ratchet device 111, such as that shown in non-limiting FIG. 4. In FIG. 4, the ratchet wrench has been replaced by a ratcheting handle 112 (which replaces wrench handle 201) with pawl 113 to engage the gear teeth 114 formed integral (in this non-limiting example) to a revised ratchet receptacle bar 115 (gear teeth instead of a square bore, in this non-limiting example). Sliding the pawl 113 forward engages it into the teeth 114 and locks the handle in place. Sliding the pawl 113 back from teeth 114 disengages it from the teeth 114, thus allowing the handle 112 to pivot left or right around pin 116 to the desired position.

One skilled in the art would know that while the invention is particularly well suited for operation in confined spaces (FIG. 3A), it is also suitable for use in normal circumstances.

The invention, in one embodiment, shown in a non-limiting example with tongs shaped for deforming rings, is shown in FIG. 1. Another embodiment merely replaces the solid handle (103) with another ratchet receptacle bar and ratchet mechanism. In this embodiment, both ratchets may be used to effect the tongs at oblique angles to the handles' positions.

One skilled in the art would know that a ratchet receptacle bar 106 can replace either or both handles and (with a ratcheting mechanism) the same end result would be achieved. One skilled in the art would know that a ratcheting mechanism can be a breaker bar, T-handle, or socket wrench. A breaker bar can be described as a handle attached to a shank at a right angle. A T-handle is a handle attached to a shaft at a right angle, usually in the middle of the handle, with a shank attached to the end of the shaft in line with the shaft.

What is claimed is:

1. An adjustable stroke device comprising:

a first handle coupled to a first tong;

a receptacle bar coupled to a second tong;

a ratcheting mechanism detachably coupled to the receptacle bar, the ratcheting mechanism having a second handle, wherein the vector of the second handle is adjustable respective to the vector of the receptacle bar by actuation of the ratcheting mechanism; and a pivot mechanism coupled to both the first handle and receptacle bar, wherein the first handle and the receptacle bar are movable about the pivot mechanism such that the first and second tongs move toward or away from each other in relation to the movement of the first handle and the second handle of the receptacle bar, wherein the ratcheting mechanism is a socket wrench.

2. The apparatus of claim 1, wherein the first handle is configured to receive a second ratcheting handle.

3. The apparatus of claim 1, wherein the pivot mechanism is formed by a pin.

4. The apparatus of claim 1, wherein the pivot mechanism is formed by a molded mating of the first handle and the ratchet receptacle bar.

5. The apparatus of claim 1, wherein the pivot mechanism operates by lever action.

6. The apparatus of claim 1, wherein the second handle travels in a plane that is parallel to the travel plane of the first handle.

7. The apparatus of claim 6, wherein the first and second handles are configured to cross one another in parallel planes.

8. An adjustable stroke device comprising:

a first handle coupled to a first tong;

a receptacle bar coupled to a second tong;

a ratcheting mechanism detachably coupled to the receptacle bar, the ratcheting mechanism having a second handle, wherein the vector of the second handle is adjustable respective to the vector of the receptacle bar by actuation of the ratcheting mechanism; and a pivot mechanism coupled to both the first handle and receptacle bar, wherein the first handle and the receptacle bar are movable about the pivot mechanism such that the first and second tongs move toward or away from each other in relation to the movement of the first handle and the second handle of the receptacle bar, wherein the ratcheting mechanism is a breaker bar.

9. The apparatus of claim 8, wherein the first handle is configured to receive a second ratcheting handle.

10. The apparatus of claim 8, wherein the pivot mechanism is formed by a pin.

11. The apparatus of claim 8, wherein the pivot mechanism is formed by a molded mating of the first handle and the ratchet receptacle bar.

12. The apparatus of claim 8, wherein the pivot mechanism operates by lever action.

13. The apparatus of claim 8, wherein the second handle travels in a plane that is parallel to the travel plane of the first handle.

14. The apparatus of claim 13, wherein the first and second handles are configured to cross one another in parallel planes.

* * * * *